US005570844A

United States Patent [19]

Thomart

[11] Patent Number: 5,570,844

[45] Date of Patent: Nov. 5, 1996

[54] METHOD FOR TUBULAR ROTARY BALL MILL OR MILL WITH SIMILAR GRINDING INSTRUMENTS

[75] Inventor: Francis Thomart, Ottignies, Belgium

[73] Assignee: Slegten S.A., Louvain-la-Neuve, Belgium

[21] Appl. No.: 290,740

[22] PCT Filed: Oct. 21, 1993

[86] PCT No.: PCT/EP93/02907

§ 371 Date: Jun. 8, 1995

§ 102(e) Date: Jun. 8, 1995

[87] PCT Pub. No.: WO94/09906

PCT Pub. Date: May 11, 1994

[30] Foreign Application Priority Data

Oct. 28, 1992 [EP] European Pat. Off. ..... 92870178

[51] Int. Cl.[6] ..... B02C 23/08

[52] U.S. Cl. ..... 241/19; 241/24.1; 241/29

[58] Field of Search ..... 241/18, 19, 29, 241/34, 24.1

[56] References Cited

U.S. PATENT DOCUMENTS

| | | | |
|---|---|---|---|
| 1,787,897 | 1/1931 | Durnin . | |
| 2,916,215 | 12/1959 | Weston et al. . | |
| 3,144,212 | 8/1964 | Klovers . | |
| 3,690,570 | 9/1972 | Root | 241/34 |
| 4,026,479 | 5/1977 | Bradburn et al. | 241/30 |
| 4,225,091 | 9/1980 | Steier | 241/24 |
| 4,597,535 | 7/1986 | Fontanille | 241/30 |
| 5,024,387 | 6/1991 | Yeh | 241/21 |
| 5,251,826 | 10/1993 | Schonbach et al. | 241/19 |

FOREIGN PATENT DOCUMENTS

| | | |
|---|---|---|
| 485735 | 4/1976 | Australia . |
| 763140 | 7/1971 | Belgium . |
| 1161748 | 1/1964 | Germany . |
| 2133431 | 11/1978 | Germany . |
| 3903256 | 3/1991 | Germany . |
| 389300 | 4/1933 | United Kingdom . |
| 1248251 | 9/1971 | United Kingdom . |

*Primary Examiner*—John M. Husar
*Attorney, Agent, or Firm*—Jacobson, Price, Holman & Stern, PLLC

[57] ABSTRACT

Method for grinding intended for a rotary ball mill (4, 5), or mill with similar grinding instruments, which is divided into at least two grinding compartments (1, 2) and which is passed through by a current (14) of sweeping air from upstream to downstream and is in a closed circuit; the said mill including at least one separation partition (3) which, between two grinding compartments (1, 2) forms a small compartment (7) bounded by upstream (8) and downstream (9) walls pierced with slots (10); the said partition (3) being provided with means (12) for lifting the material, whilst not having any mechanical means for diverting the material downstream, and the material being capable of circulating diametrically through the small compartment (7) of the partition (3); means for regulating the mass of material passing through the mill, and means for regulating the quantity of sweeping air passing through the grinder being provided; this method being characterized in that a partition (3) is used which is provided with means preventing the material from passing through the central part (15) of its downstream wall (9), and in that the transfer of the material from the grinding compartment upstream of the partition to the compartment downstream is carried out essentially by the combined effect; a) of the pressure difference within the material situated in the compartments upstream and downstream of the partition, and b) of the quantity of sweeping air passing through the mill; the level of material in the small compartment formed by the partition being regulatable, by setting the mass of material passing through the mill and the quantity of air sweeping the mill.

8 Claims, 4 Drawing Sheets

METHOD FOR TUBULAR ROTARY BALL MILL OR MILL WITH SIMILAR GRINDING INSTRUMENTS

BACKGROUND OF THE INVENTION

The invention relates to a method for tubular rotary ball milling or mill with grinding instruments, comprising at least two grinding compartments separated by a partition, the mill being passed through by a current of sweeping air and working in a closed circuit manner.

The partition which is situated between two of the grinding compartments, makes it possible to control the quantity of material in the compartment situated upstream.

The invention is particularly intended for ball mills, or mills with similar grinding instruments, for cement, in a closed circuit. Generally, these mills have two compartments, namely a preparing compartment with balls with a diameter of 90 to 60 mm and a finishing compartment with balls with a diameter of 40 to 20 mm. In order to avoid dust and excessive heating of the cement during grinding, cement mills are passed through by a current of sweeping air, from upstream to downstream. The partition which separates the first and second compartment of these mills is for this reason called the intermediate partition.

In cement mills, the raw material is supplied at approximately 80% under the size of 20–25 mm, and the work of the first chamber consists of reducing it to approximately 100% under the size of 5 mm, with 95% under the size of 2.5 mm. In fact, to obtain a good grinding efficiency, it is necessary for there to be a large quantity of 20 mm balls in the second compartment. Moreover, these balls work well only insofar as the fineness criteria given above are respected at the inlet of the second chamber, and in particular as there are practically no more particles greater than 5 mm in size.

In a cement mill, the intermediate partition has several functions, it must:

- retain the large balls upstream, and the finer charge of the second compartment downstream;
- prevent the coarse particles from leaving the first compartment;
- allow the fairly fine material to pass to the second compartment; and
- allow the sweeping air to pass.

The above functions can be carried out with single-walled or double-walled partitions. The invention relates to double-walled partitions.

Single-walled partitions are actually practically never used in modern cement grinders; since they wear out on both their faces, they have too short of a lifetime, and in addition their resistance to stresses in the axial direction of the mill is not sufficient. Moreover, with a single partition, the sweeping with air has a very small influence on the filling of the first compartment with material, and an essential characteristic of the invention—using the sweeping of air as a regulating means—could not be produced efficiently.

Patent DE-A-2,133,431 describes a typical embodiment of double-walled partitions used for separating the grinding compartments of modern cement mills. The partition includes a framework consisting of openwork segments, onto which there are bolted, upstream, grilles which allow the cement to enter the partition, and, downstream, shielding plates which make a central discharge opening. The grilles and the rear plates are subjected to strong wear only on one side, and because of this they have better durability than the grilles of single-walled partitions; when they are replaced, the framework is kept.

Slots of approximately 6 mm are provided in the grilles of the upstream wall of the intermediate partitions, the edge of the slots undergoes a small degree of working by the impacts of the balls, the particles larger than 5 mm cannot pass through these slots. If the slots are larger, in the event of disturbance of the operation of the mill, even for a short time, excessively large particles can pass into the second compartment, and they will remain trapped in the balls of 20 mm diameter which are too small to reduce large particles, and this can hamper the running of the mill for several days, with a loss in capacity which can be up to 20%.

Although it is possible, by dimensioning the slots of the upstream wall of the intermediate partition, to fulfil the first fineness criterion at the outlet of the first compartment, i.e. 100% under 5 mm in size, it is impossible to make slots which satisfy the second criterion, i.e. 95% under 2.5 mm in size. In fact, it is not possible to provide sufficiently small openings in the cast steel pieces which, for reasons of wear resistance, make up the upstream face of the partition: the sand cores used to obtain the slots when the metal is cast would not have the required mechanical strength. Even if it were possible to make such small slots, they could not be used, because the passage area would not be sufficient to let through the very high flow rates of cement and air which pass through a modern cement mill.

The work of the first compartment must consequently be such that when the material arrives at its outlet end, against the intermediate partition, it is perfectly prepared, because with the exception of the coarse particles, it will pass freely through the slots of the upstream wall.

In a large cement mill, in closed circuit, the dwell time of material in the first compartment is of the order of 2 to 3 minutes. To reduce the materials to the requisite fineness under these conditions, the dwell time is an essential element.

The dwell time depends directly on the filling of the compartment with material, if there is too little material, the dwell time in the grinding bodies is too short; if there is too much material, the dwell time is too long, and the working of the grinding bodies is too greatly damped; in both cases, the grinding in the first chamber is not sufficient, and the material is not optimally prepared therein.

The framework sectors are provided with lifters which, during the rotation of the mill, lift the material which has penetrated through the slots of the grilles to the top of the mill, from where the material falls onto a cone which diverts it towards the downstream compartment. At the center of the cone, a grille allows the air to pass and prevents the balls from passing from one compartment to the other. The lifters and the cone must be very powerful, in order to be capable of treating the highest throughputs which the mill may be called on to transport, the material which penetrates into the partition is very quickly transferred into the second compartment, the small compartment formed by the double wall of the partition contains little material and has only a small retention effect on the material contained in the first compartment.

Moreover, in a cement mill, the balls of the first compartment are relatively coarse—with a diameter of from 90 to 60 mm—to crush the material supplied to the mill. Such balls are highly permeable to the passage of the material; when it is not retained by the intermediate partition, and such is the case of partitions similar to those of Patent DE-A-2,133,431, there is generally too little material in the first chambers.

If there is too little material in the first compartment, it has been seen that the dwell time therein is too short and the material is poorly prepared for the second compartment, but this has other drawbacks:

a proportion of the grinding bodies then works without material, and hence where is a loss in efficiency;

The shieldings and the balls of the mills, which are subjected to high wear stresses, are cast from very hard alloy castings which are the most economical, and when there is too little material mixed with the balls, these casts splinter and break, which causes maintenance problems and a highly expensive loss in capacity.

Patent GB-A-1,248,251 describes a particular form of partition, which comprises an upstream face pierced with slots, except for the center, and a solid downstream wall, except for a central opening which is optionally protected by a mesh, and in the preferred embodiment, there is no lifter inside the partition, the material being discharged into the downstream compartment by overspill. With these partitions, there is most often too much material in the first compartment, which can be corrected only by irreversibly increasing the diameter of the central opening.

In view of the importance of keeping a quantity of cement in the first chamber which suits the working conditions, neither too much nor too little, the attempts have for some years been made to use intermediate partitions for controlling the quantity of material mixed with the balls, in a regulatable manner. For mechanical reasons, the various attempts made in this direction have long been ineffective. Mention may be made on this subject of U.S. Pat. No. 1,787,897, whose regulatable parts seize up rapidly.

More recently, new types of partition have been proposed with a view to reliably regulating the level of the material in the first compartments of cement mills.

The method which has proved most effective consists in using a double-walled partition and in regulating the level of material between its two walls; the level of the material in the compartment upstream of a partition actually depends on the level in the latter.

Belgian Patent BE-A-763,140 relates to a partition with rotating blades which can be actuated continuously, during the running of the mill. The rotation of the blades makes it possible to control the level in the partition and in the upstream compartment. Unfortunately, the mechanism for controlling the blades proved difficult in the environment of a grinding factory; despite various improvements, the control of the blades according to Belgian Patent BE-A-736,140 never reached the required reliability, and few industrial applications have been made of these partitions.

Belgian Patent BE-A-851,835 relates to a partition with manually controlled rotating blades. These partitions have undergone very widespread industrial developments since their inception, and the concept of a regulatable-level partition is very widespread in the cement industry. However, in order to rotate the blades, the mill must be shut down, it must be allowed to cool, the manhole of the second compartment must be opened and the mill must be entered. This takes several hours in total, and since certain cement mills change their type of production several times per day, it is not possible to consider regulating the blades for each type of product. The blades are therefore set in a compromise position for all the types of production, which does not correspond to the optimum for each type of production. Moreover, changes in the grindability of the material fed to the mill may require a different charge of material—for example, to optimize the grinding when the material is moist, it is advantageous to reduce the quantity of material in the first chamber. The partition according to Belgian Patent BE-A-851,835 is therefore an interesting solution, but because it cannot be adjusted during the running of the mill, it is a flawed solution.

Patent DE-A-3,903,256 presents another solution; for controlling the level of material in the partition, the position of a ring is adjusted, so as to adjustably enclose the passage openings, through which the material can escape towards the center from the peripheral zone fitted with lifters. The partitions according to Patent DE-A-3,903,256 have the same drawbacks as those of Patent BE-A-851,835: they cannot be regulated continuously during rotation of the mill.

In summary, existing double-walled intermediate partitions can be split into two categories:

Those which include mechanical transport means, generally consisting of a set of lifters and a cone for transferring the product from one compartment to the other. Sometimes the cone is absent and replaced by another diverting device, such as for example the inclined end plate of the blades in Patent BE-A-851,835; there are sometimes regulating means, such as the rotating blades of the same patent BE-A-851,835, which set the filling in the partition; but the substance of the principle remains that of mechanically transporting the material through the partition.

Those with a barrier effect, where a level is ensured upstream by dimensioning an overspill threshold, for example the diameter of the central opening in Patent GB-A-1,249,251. The partitions according to U.S. Pat. No. 1,787,897, already mentioned, can be likened to this; they would allow, if they could be produced without their mechanism seizing up, the slots of the upstream wall to be closed progressively from the periphery towards the center, the progressive closure of the slots producing a barrier effect with an adjustable threshold.

SUMMARY OF THE INVENTION

The Document AU-B-485 735 mentions the positive influence of a proper filing of the first compartment and propose to achieve it through the dam created by the accumulation, inside the partition, of the material to be ground.

Such document shows the possibility of adapting the level of the dam of material mentioned hereabove through a mechanical means of regulation.

Such document shows the possibility of adapting the level of the dam of material mentioned hereabove by modifying the structure of the partition. It is a difficult and definitive process that cannot be assimilated to a real regulation.

The document U.S. Pat. No. 3,144,212 shows a solution applicable only to the wet process (see col. 1, lines 9 & 10). The center of the partition is closed and the material leaves the partition towards the downstream compartment through slots in the circular walls on the side of the downstream compartment. Since the fluidity of a liquid is obviously different than the one of a dry material, solutions used in that document cannot be extrapolated to devices and methods for the communition of dry material.

OBJECTS OF THE INVENTION

The present invention aims to provide a method intended for a tubular rotary ball mill or mill with similar grinding instruments, making it possible to control the quantity of material in the mills, which are both simple and efficient, and, which do not have the drawbacks of the state of the art, and in particular which make it possible to control the quantity of material continuously.

The invention also aims to offer a method for grinding which has a higher efficiency than those of the state of the art.

Furthermore, the grinding method according to the invention reduces the wear and therefore the cost of the devices.

More specifically, the invention provides a partition for a tubular rotary mill which is particularly simple, and because of this inexpensive to produce.

A first aspect of the Invention relates to a method for the comminution of dry material, such as e.g. cement clinker, wherein (a) the material goes from upstream to downstream through a tube mill filled with grinding media, such as e.g. balls, the mill being divided into at least two grinding compartments, each division being achieved by means of a partition consisting of two walls, each of them being perforated with slots, the volume between the upstream wall and the downstream wall being a small compartment in which the material enters through the slots and is lifted by elevating vanes but is not diverting downstream by any mechanical means, the material being capable of circulating diametrically through the small compartment of the partition;

(b) the tube mill is ventilated by an air flow proceeding from upstream to downstream;

(c) the mill is working in a closed circuit arrangement wherein the material leaving the tube mill goes through a dynamic separator;

(d) the circuit is provided with means for regulating the total quantity of material entering into the tube mill, by controlling (I) the raw material and (II) the unsufficiently ground material sent by the dynamic separator back to the tube mill;

(e) the circuit is provided with means for regulating the quantity of air going through the tube mill;

(f) the circuit is provided with at least one electric sound pick-up, located next to the first compartment of the tube mill in order to have a relative measurement of the level of the material in the compartment;

characterized in that (g) the material inside the partition is leaving the partition only through the slots made in the peripheral part of the downstream wall of the partition, the central part of the partition being provided with means preventing the material from passing through it;

(h) inside the partition, the material is carried towards the downstream compartment under the combined effects (I) of the difference of pressure of the material to be ground between the inlet and the outlet of the mill which pushes the material towards the outlet and (II) of the air flow, (i) the level of the material to be ground is regulated inside the partition by holding constant two set points viz. (I) the quantity of material entering into the tube mill and (II) the quantity of air passing through the mill.

The transfer of the material from the grinding compartment upstream of the partition to the downstream compartment being produced principally by the effect of the pressure difference within the material situated in the compartments upstream and downstream of the partition, and a secondarily by the sweeping air, the level of material being regulatable by setting through the mass of material passing through the mill and the quantity of sweeping air, without the running of the mill needing to be interrupted.

More precisely, the invention relies on the indepth study in a pilot station of the process of advancing the material through a ball mill or mill with grinding instruments similar to balls (for the purpose of simplicity, "balls" will from hereon be written for "balls or similar grinding instruments"), which study made it possible to make the observations summarized hereinbelow.

For the material to progress through a ball mill, the driving pressure within the material must be greater than the pressure drop caused by the balls, and there is a relationship between the pressure within the material and the quantity of material mixed with the balls.

If, in a mill, the balls have a given dimension and the throughput is progressively increased, the cavities between the balls fill up, and when they are full, the balls move apart; during this process, the quantity of material increases and the pressure rises within the material. Above a certain filling point of the material, there is a breakdown in the advance process, the pressure in the material drops, it no longer progresses and there is a tendency towards blockage.

The smaller the balls, the less permeable they are, and the greater their resistance to the passage of the material, and the smaller are the flow rates for which filling of the spaces, separation of the balls and breakdown of the advance process occurs.

The invention is particularly intended for cement mills, and in these mills, since the balls of the second chamber are relatively small, their permeability is relatively low: the pressure required within the material to make it progress to the outlet, at the throughput of the mill, is generally reached only when the compartment is well filled.

In the first chamber, where the balls are coarser, and therefore more permeable, the pressure remains low within the material, and it progresses without the compartment being so greatly filled.

DESCRIPTION OF A PREFERRED EMBODIMENT OF THE INVENTION

Figure 1:
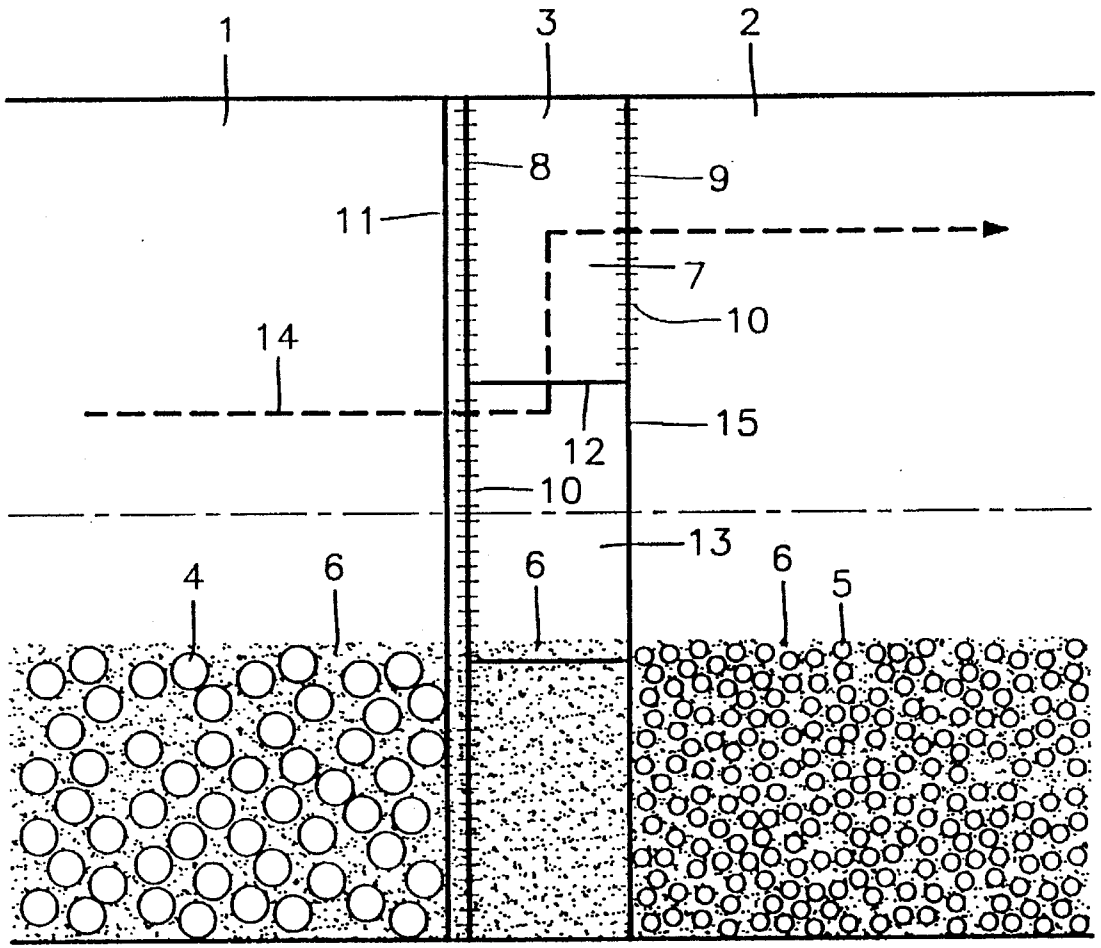
FIG. 1 is a diagrammatic partial longitudinal section through a mill equipped with a partition for achieving the method according to the invention.

In order to explain the principle of operation of the method according to the invention, reference is made to FIG. 1, which represents a portion of a ball mill. The mill has two compartments 1 and 2, separated by a partition 3. Ball mills are well known, it is known that they are supported and driven so as to rotate about their horizontal axis. In FIG. 1, the material is supplied at the inlet of the compartment 1 and removed at the outlet of the compartment 2, the supply and removal devices for the material are known and are not represented.

For greater clarity, the representation of the mill is diagrammatic, and neither the shielding protecting the shell nor the constructional details of the partition 3 are shown. The compartments 1 and 2 are partially filled with balls 4 and 5 with the material 6.

The intermediate partition forms a small compartment 7, its upstream 8 and downstream 9 walls are provided with slots 10. It is assumed that the slots of the upstream wall are closed by a plate 11, the drainage device at the outlet of the compartment 2 also being closed, the two compartments are normally filled with material 6, the supplies of material and of air are cut off, and the mill is in rotation.

The pressure within the material 6 in the compartment 2 makes it pass through the slots 10 and the downstream wall 9 of the partition until the pressure in the small compartment 7 is equal to the existing within the compartment 2.

When the outlet of the mill is freed, the plate 11 is removed and a normal throughput is set up in the mill, the material 6 will be able to penetrate from the first compartment 1 into the partition 3 only when the pressure in the compartment is greater than that existing in the partition and therefore in the second compartment: the transfer of the material from the first compartment to the second compartment occurs under the effect of the pressure difference within the material situated in the compartments upstream and downstream of the partition. Consequently, the pressure within the first compartment—and therefore its degree of filling with material—is no longer dependent on the permeability of its charge, but on the less permeable charge of the second compartment.

The mills for which the invention is intended are closed-circuit mills. According to a well-known arrangement for cement mills, with this type of circuit, the raw material is supplied at the inlet of the mill (the compartment 1 in FIG. 1), it passes through the mill, from where it is removed to an elevator which conveys it to a dynamic separator. The latter separates the finished product from the insufficiently ground product. The first leaves the circuit, and the second is returned to the inlet of the mill, where it rejoins the raw material. Modern closed-circuit mills are provided with a means for measuring the quantity of material returned from the dynamic separator to the mill, and means acting on the parameters of the circuit, in order to control, via a regulation device, the supply rate of the raw material and the quantity returned from the separator to the mill. The sum of the raw material supply and of the quantity returned to the mill constitutes the mass of material passing through the mill; this mass throughput is therefore controlled by the device for regulating the means acting on the parameters of the circuit, that is to say that it can be increased, reduced and held at a set-point value.

By setting the mass throughput in the mill, the pressure in the second compartment is modified, as is, as explained hereinabove, the quantity of material retained in the first compartment.

In a grinding circuit equipped with a partition according to the invention, the quantity of material to be retained in the first compartment will be taken into account for determining the mass throughput. However, the choice of the mass throughput has a great influence on the running of the circuit, and in particular on the degree of fineness of the finished product. In order to define the mass throughput, numerous factors must be considered, which vary from circuit to circuit. Most often, the optimum mass throughput will not be that which leads to ideal filling of the first compartment.

The method according to the invention uses the flow of sweeping air as an additional element for reaching the ideal level of material in the first chamber.

The sweeping air 14 passes through the mill from upstream to downstream, and to avoid dust and excessive heating of the cement by the heat released during the grinding, its flow rate is regulatable.

According to the invention, the small compartment 7 in FIG. 1 is provided with means 12 for lifting the material 6, and the partition does not have any device for diverting the material downstream, and the material can circulate diametrically through the small compartment 7 of the partition.

During rotation of the mill, when the lifting means 12 are in the low part of their cycle, they carry along the material retained in the partition, which they allow to fall back when they are in the top position of their cycle.

The material, preferably cement, a part of which passes diametrically through the small compartment of the partition, is vigorously mixed with the sweeping air 14, enters the partition through the slots 10 of its upstream wall and leaves therefrom through the slots of the downstream wall, away from the trajectories of the balls.

The central part 15 of the downstream wall is solid. In fact, if the air/cement mixture were not to be prevented from leaving through the center of the partition, a dominant part of the transfer of the material from the first compartment to the second would occur by means of the air/material mixture passing through the central part 15 of the downstream wall, replacing the effect of the pressure difference within the material situated in the compartments upstream and downstream of the partition, and suitable filling of the upstream compartment would not be ensured.

In view of the effectiveness of the air/cement mixing in the partition, the effect of a small variation in the air flow rate on the proportion of the cement carried by the air out of the partition is large, and greater than in the grinding chambers.

If the mill in FIG. 1 is in equilibrium, and the quantity of sweeping air is then increased, an imbalance is created in the partition—a part of the material transferred by the pressure difference effect between upstream and downstream being transported by air—the result being the same as if the mass throughput were reduced, the level of material in the first chamber falls. Conversely, if the quantity of sweeping air is reduced, the level of material in the first chamber increases.

Figure 2:
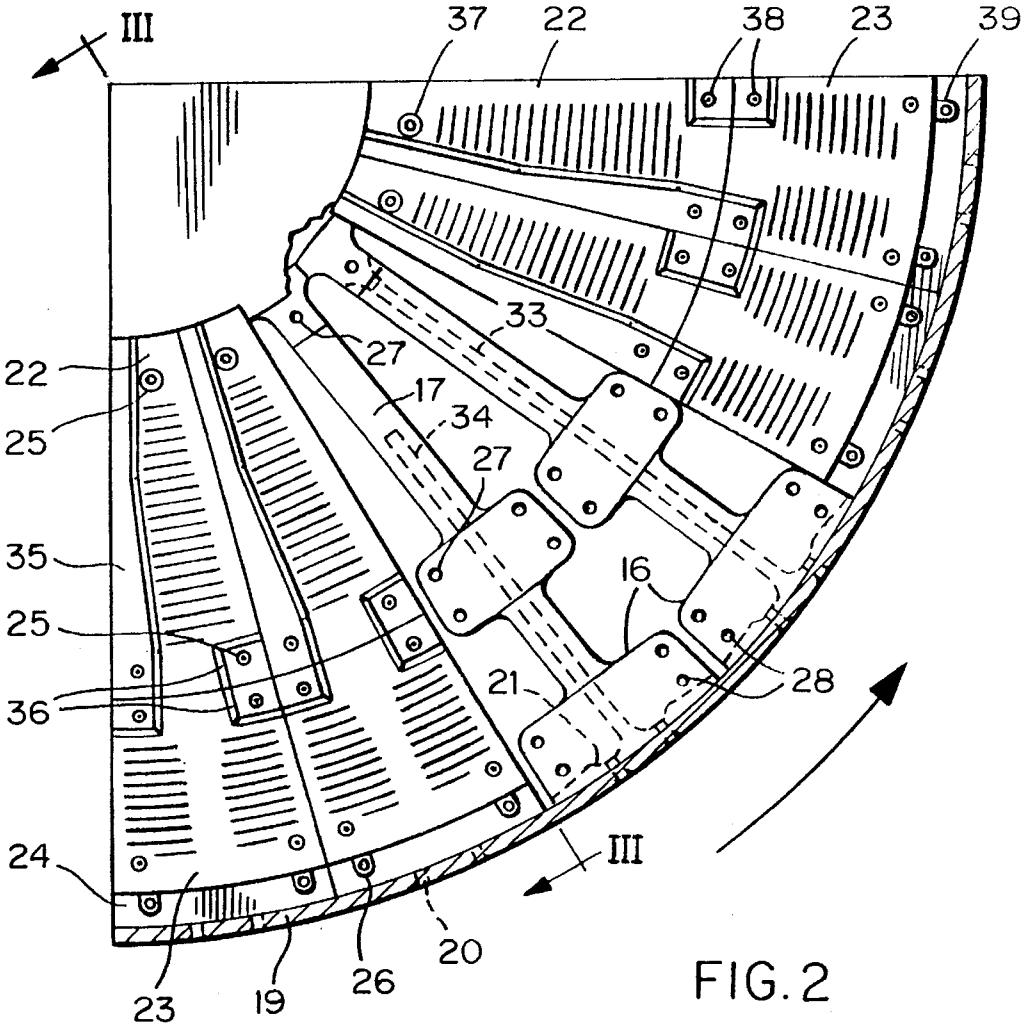
FIG. 2 represents a partition portion according to one preferred embodiment of the invention, and more precisely it shows a quarter of the partition seen from the inlet of the mill, part of the grilles being removed to show two framework sectors.
Figure 3:
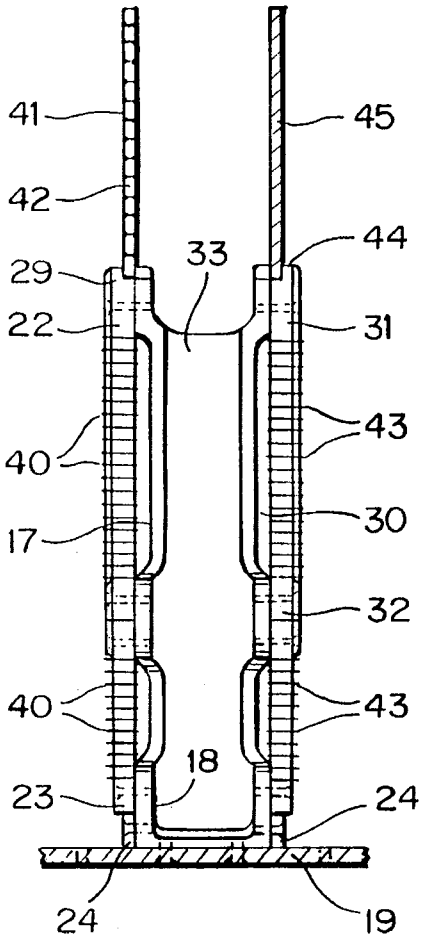
FIG. 3 represents a section of the partition in FIG. 2, along the line III—III which passes between two framework sectors.

FIGS. 2 and 3 represent a preferred embodiment of the partition used in the method of the invention.

The partition is mounted between the two grinding compartments of a rotary ball cement mill; the mill is passed through by a current of sweeping air from upstream to downstream and is in closed circuit.

In FIG. 2, the partition is seen from the inlet of the mill, two grilles 22, and two grilles 23 being removed to show the upstream face 17 of two frame elements 16. The mill rotates in the direction of the arrow.

The framework elements are made of cast steel. Their foot forms a U 18, which is bolted to the shell 19 of the mill by means of the holes 20 in the shell and 21 in the foot 18. For greater clarity, the bolts are not represented in FIGS. 2 and 3.

The upstream face of the framework elements 16 carries the grilles 22 and 23 and ring elements 24. They are bolted to the framework by means of the holes 25, 26, 27, 28. At the bolts, the elements 16 are enlarged to ensure correct positioning of the grilles and of the ring elements.

The downstream face 30 of the framework elements is symmetrical with its upstream face 17; it carries grilles 31 and 32 and ring elements 24 bolted to the elements 16 like the grilles 22 and 23 and the ring elements 24 of the upstream side.

The upstream 17 and downstream 30 faces and the foot 18 of the framework elements are connected by alternately long 33 and short 34 flats in the successive frameworks. The flats 33 and 34 form the core of the framework elements and ensure their rigidity against axial thrusts caused by the balls which partially fill the grinding compartments adjacent to the partition on the upstream and downstream side, as is represented in FIG. 1.

The flats 33 and 34 also act as means for lifting the material. Being alternately long and short, they provide easy passage for the cement from the periphery of the partition towards its central part, which is totally free, so that during rotation of the mill, the material can circulate diametrically through the partition when it is tipped out from the flats 33 and 34; good stirring of the air and the cement is thus ensured.

The grilles 22, which experience has shown to be most greatly subject to wear, are provided with ribs 35 for reducing the sliding of the balls against the grilles, and consequently the wear. Bosses 36 protect the bolt holes most exposed to wear in the grilles 22 and 23. Cavities 37, 38 and 39 are made in the grilles 22, 23 and the ring elements 24, into which the heads of the bolts fit flush in order to protect them from wear. The grilles 22 and 23 have 6 mm slots 40 to retain the unground particles larger than 5 mm, for the reasons explained in the section on the state of the prior art.

The ring elements 24 protect, upstream and downstream, the foot 18 of the framework elements 16 against wear. They have the same height as the shielding (not shown), adjacent to the partition, of the shell 19. This makes it possible to dismount the grilles 23 and 32 without having to dismount the shell shieldings, which is a great advantage for maintenance.

All the elements of the partition, and in particular the framework elements 16, the grilles 22, 23, 31 and 32 and the ring elements 24 are designed to be able to be inserted into the mill through its inlet opening/ journal. The grilles are divided so that the grilles 22 and 31 correspond to the design with greatest wear, and in general is thus possible, half the time, to keep the grilles 23 and 32 whilst replacing the grilles 22 and 31.

The grilles 22 have a notch 29 in which a thick central mesh 41 is housed, which is provided with slots 42 sufficiently small to retain the particles not ground in the first compartment, whilst allowing a portion of the sweeping air to pass through.

In fact, the free surface—not cover by the paths of the balls—of the slots of the grilles 22 and 23 is most often not sufficient to allow all of the sweeping air of the mill to pass through without causing an excessive pressure drop.

The grilles 31 and 32 have 12 mm slots 43, to have a maximum passage surface area; their function being to connect the partition with the second compartment over as wide an area as possible, whilst preventing the balls from penetrating into the partition; they must not restrict the passage of the particles which have passed through the grilles 22 and 23 towards the partition and the second compartment.

The grilles 31 and 32 are symmetrical with the grilles 22 and 23, and differ from them only by the width of the slots. The grilles 31 have a notch 44 similar to the notch 29 of the grilles 22. A metal sheet 45 is housed therein and being solid it closes the center of the partition and constitutes the means preventing the transfer of the material through the central part of its downstream wall.

With 12 mm slots, the useful passage surface area of the grilles 31 and 32 is equivalent to the total useful surface area of the grilles 22 and 23 and of the central mesh 41.

The partition does not have any mechanical device for diverting the material downstream.

The material is transferred from the upstream grinding compartment to the downstream compartment, as for the partition diagrammatically represented in FIG. 1, essentially by the combined effects:

a) of the pressure difference within the material situated in the compartments upstream and downstream of the partition, and b) of the quantity of sweeping air passing through the mill. The grinding circuit equipped with the partition is provided with a device for regulating the parameters of the circuit, it controls the mass throughput in the mill and can keep it at a set-point value, preferably using management software.

The set-point value is preferably chosen as a function of the degree of fineness required for the cement.

A current of sweeping air, with a regulatable flowrate, passes through the mill from upstream to downstream. An electric pickup, situated near the mill, in line with the first compartment, gives a relative measurement of the mass of material in this compartment. A regulation device controls the flow rate of sweeping air to keep a set-point value of the electric pickup.

The set-point value chosen for the mass throughput in the mill ensures preadjustment of the level of material in the small compartment formed by the partition; whilst the set-point value of the electric pickup should correspond to the level of material in the partition which gives optimum filling in the first compartment. The slaving of the sweeping air flow rate to the electric pickup constantly corrects this flow rate, to maintain optimum filling of the first compartment in spite of variations in the running of the mill.

The partition in FIGS. 2 and 3 combines the characteristic elements of the partition used in the method of the invention in a form which is simple, robust and resistant to wear; it provides a highly effective solution for controlling the level of material in the first compartment in a continuous manner.

The fact that the central part of the partition is completely closed downstream by the metal sheet 45 forcefully prevents the entry of balls from the second compartment into the partition, which is a great advantage compared to existing partitions.

The framework elements 16 may be made of sheet metal which is mechanically assembled and welded, instead of cast steel, this solution is often advantageous when the elements of the partition cannot be inserted into the mill through the inlet opening, but must pass through a smaller manhole; the framework elements are then divided into pieces which are welded after having passed through the manhole. In this case, the central mesh 41 and the metal sheet 45 are divided into two pieces to pass through the manhole, which pieces are joined together by welding when they are in the mill.

Figure 4:
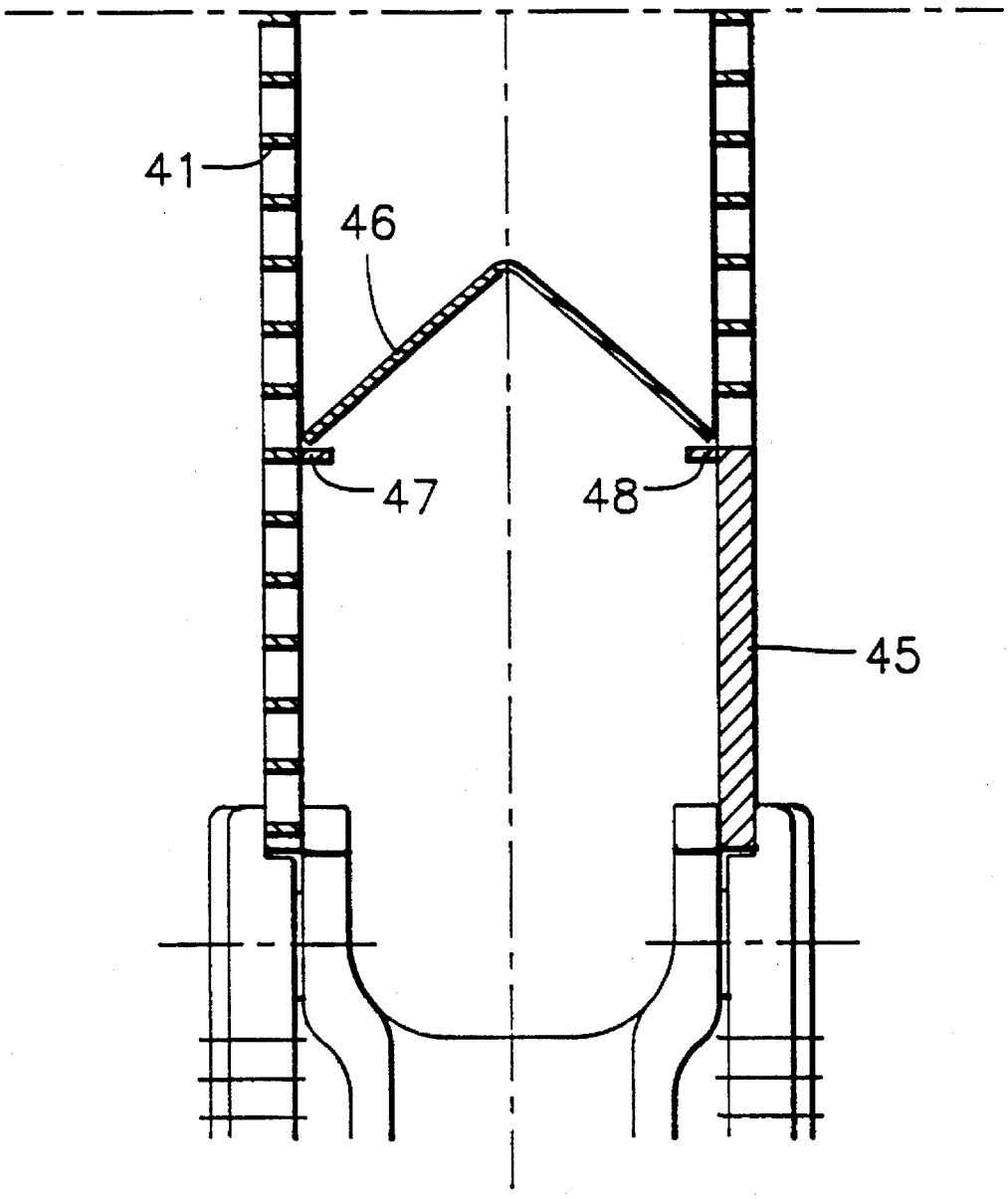
FIG. 4 represents an alternative version of a partition for achieving the method of the invention, along a section equivalent to the central portion of FIG. 3.

When the surface area of the slots of the grilles of the downstream wall is not sufficient to ensure passage of the sweeping air, the slots can be made over a portion of the central part of the downstream wall, while providing a baffle which prevents the passage of an appreciable quantity of cement through these slots. By way of example, in FIG. 4, the central downstream plate 45 is pierced with slots at its center. A circular top-shaped baffle 46 connects the pierced part of the central downstream plate to the central part of the upstream mesh 41, and the baffle has a reduced diameter half way along, so as to not substantially hamper the diametrical passage of the material through the partition. The paths of the balls and of the cement from the first chamber practically do not pass in front of the central part of the mesh 41, so that the air, which passes through the baffle and is conveyed towards the slots of the central downstream plate and the second chamber, carries little cement. Subtracting this cement from that which passes through the compartment formed by the partition does not disturb the regulation of the level in the partition substantially, as long as the quantity of air passing through the baffle is limited by its reduced part. The baffle 46 in FIG. 4 is held by the flanges 47 and 48 respectively welded to the mesh 41 and to the plate 45.

In modern cement mills, it is often sought to keep the temperature of the air constant at the outlet of the mill, in order to ensure effective control of the temperature of the finished product.

Figure 5:
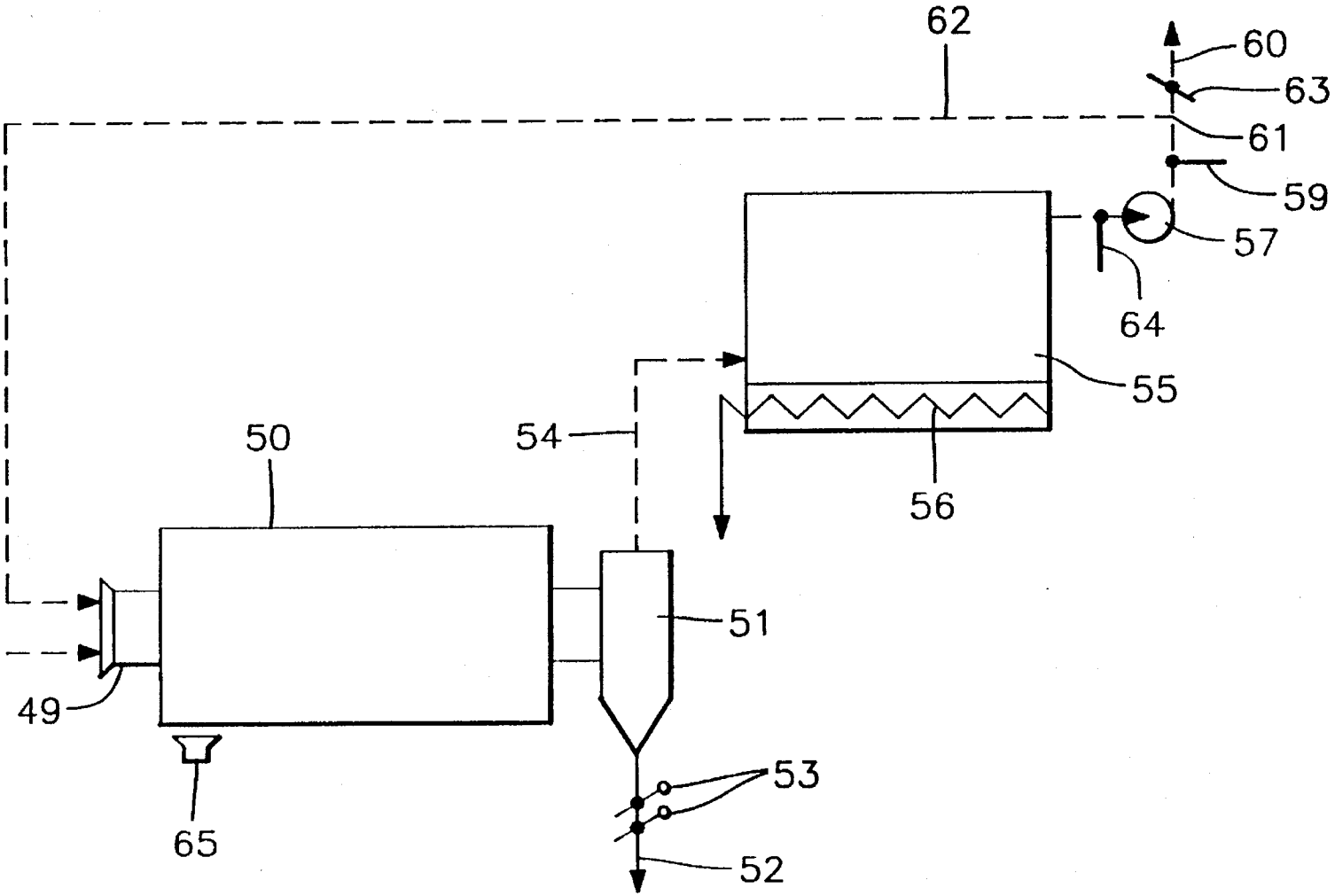
FIG. 5 represents an advantageous block diagram of the sweeping air circuit with a device according to the invention.

In this case, it is an advantage to provide, for the mill, an air circuit according to FIG. 5. The air enters the circuit through the inlet 49 of the mill 50 and leaves therefrom in the discharge box 51 in which the bulk of the cement is separated from the air and is removed through the chute 52 isolated by a double valve 53. The air still containing dust is removed through the pipe 54 to a dust-removing bag filter 55 separating the dust from the air. The dust is removed by the screw 56, the air is sucked through the fan 57 with regulatable speed or provided with motorized vanes, not shown.

The air flowrate is measured at 59. On the pipe for removing the air to the vent 60, a T 61 is mounted, which diverts a part of the air towards the inlet of the mill through the pipeline 62. Downstream of the T, there is a motorized regulating valve 63. The temperature of the air is measured at 64.

The quantity of material in the first chamber is measured, for example by an electric pickup 65 located near the mill. As a function of the measurement given by the pickup 65, a regulation system sets the set-point value of the air flow rate with a view to keeping a suitable charge of material in the first compartment.

The air flow rate chosen is obtained by regulating the speed/vanes of the fan 57.

The temperature of the air is kept constant by setting the position of the valve 63 which makes it possible to regulate the relative quantities of fresh air and air recirculated to the inlet 49 of the mill.

We claim:

1. A method of comminuting dry material in a tube mill comprising the steps of:

passing an air flow through the tube mill in the same direction as the dry material is conveyed;

introducing said dry material at an inlet of the tube mill;

transferring the dry material to a first grinding chamber containing a bed of grinding media;

conveying the dry material in tumbling action in response to rotation of the tube mill to an upstream wall of a partition, said partition having said upstream wall and a downstream wall, said upstream and downstream walls being perforated with slots, a small compartment which is free of said grinding media being disposed between the upstream wall and a downstream wall;

transferring said dry material through said slots into the small compartment in said partition;

lifting said dry material while said dry material is inside said small compartment, using elevating vanes located radially within said partition;

pushing said dry material out of the partition into a second grinding chamber through only the slots in said downstream wall using the combined effects of (I) the pressure of the dry material being continuously fed into the tube mill and (II) the air flow which meets particles of said dry material as said particles fall downwardly, so that said partition does not require scoops or a cone to push the dry material into the second grinding chamber;

transferring said dry material in tumbling action in response to rotation of said tube mill, through said second grinding chamber, said second grinding chamber including a bed of grinding media;

discharging said dry material from the tube mill;

transferring the dry material to a dynamic separator after said dry material is discharged from said tube mill;

separating said dry material while in said dynamic separator into a first material which is sufficiently fine to represent a finished product and a second material which is not sufficiently fine;

returning said second material to the inlet of said tube mill;

regulating a total quantity of material entering the tube mill by controlling quantities of raw material entering the tube mill and by controlling the quantities of said second material returning through said inlet;

regulating the quantity of said air flow entering the tube mill;

measuring the level of said dry material in the first grinding chamber using an electric sound pick-up located next to said first grinding chamber; and regulating the level of material inside the partition by keeping the quantity of material entering the tube mill constant and by also keeping constant the quantity of air flow passing though the tube mill.

2. The method of claim 1, wherein said slots in the downstream wall are arranged only adjacent to a periphery of said downstream wall so that said downstream wall has a solid central region and so that air entering said partition is discharged through the periphery of said partition.

3. The method of claim 1, wherein air entering said partition is discharged through slots arranged adjacent to the periphery of the downstream wall and through slots arranged in a central region of the downstream wall, and wherein the dry material is prevented from passing through said slots arranged in a central region of the downstream wall by placing a first circular plate perpendicularly with respect to circular plates which define said upstream and downstream walls, said first circular plate having a V-shaped cross section and a diameter equal to the diameter of said central region of the downstream wall, the first circular plate being placed in front of the central region.

4. The method of claim 1 and further comprising the steps of measuring the temperature of air at the outlet of the tube mill; comparing said temperature to a predetermined value; adjusting the temperature of said air flow using a vane which regulates a relative proportion of fresh air and recirculated air entering the tube mill.

5. The method of claim 4 and further comprising the step of automatically adjusting at least said predetermined value using a computer.

6. The method of claim 1 and further comprising the steps of measuring the temperature of the dry material at the outlet of the tube mill; comparing said temperature to a predetermined value; adjusting the temperature of said air flow using a vane which regulates a relative proportion of fresh air and recirculated air entering the tube mill.

7. The method of claim 6 and further comprising the step of automatically adjusting at least said predetermined value using a computer.

8. The method of claim 1 and further comprising the step of automatically adjusting set point values of the method using a computer.

* * * * *